US006685519B1

(12) United States Patent
Bech et al.

(10) Patent No.: US 6,685,519 B1
(45) Date of Patent: Feb. 3, 2004

(54) SYSTEM FOR TRANSFERRING FLUIDS AND METHODS FOR INSTALLING, MODIFYING AND OPERATING SYSTEM

(75) Inventors: Arild Bech, Arendal (NO); Carl K. Arnet, Kolbjørnsvik (NO); Jan Vidar Aarsnes, His (NO)

(73) Assignee: Advanced Production and Loading AS, Arendal (NO)

( * ) Notice: Subject to any disclaimer, the term of this patent is extended or adjusted under 35 U.S.C. 154(b) by 0 days.

(21) Appl. No.: 09/959,435

(22) PCT Filed: Apr. 18, 2000

(86) PCT No.: PCT/NO00/00131

§ 371 (c)(1),
(2), (4) Date: Oct. 25, 2001

(87) PCT Pub. No.: WO00/64732

PCT Pub. Date: Nov. 2, 2000

(30) Foreign Application Priority Data

Apr. 26, 1999 (NO) ..... 19991985

(51) Int. Cl.[7] ..... B63B 22/02
(52) U.S. Cl. ..... 441/4; 114/231
(58) Field of Search ..... 114/230.1, 230.2, 114/293; 441/3–5; 414/137.5, 137.9, 138.2–138.4

(56) References Cited

U.S. PATENT DOCUMENTS

| | | | | |
|---|---|---|---|---|
| 5,065,687 A | | 11/1991 | Hampton | 114/230 |
| 5,431,589 A | * | 7/1995 | Corona | 441/4 |
| 5,816,183 A | | 10/1998 | Braud et al. | 114/230 |

FOREIGN PATENT DOCUMENTS

| | | |
|---|---|---|
| GB | 2269351 | 2/1994 |
| WO | 97/29943 | 8/1997 |

* cited by examiner

*Primary Examiner*—Ed Swinehart
(74) *Attorney, Agent, or Firm*—Foley & Lardner

(57) ABSTRACT

System for transferring fluids between a floating installation (10) and a tanker (30), wherein the floating installation is permanently moored (31, 32) to the seabed (1), and comprising a buoy (20) being moored (21A, 21B) to the seabed and connected to the installation through a first mooring line (12A) and a first fluid transfer line (12B). Buoy (20) is adapted to be connected to the tanker (30) through a second mooring line (32A) and a second fluid transfer line (32B), and the buoy (20) is immersed in the sea in its normal operative position and is provided with a swivel for the second mooring line (32A) and the second fluid transfer line (32B).

11 Claims, 5 Drawing Sheets

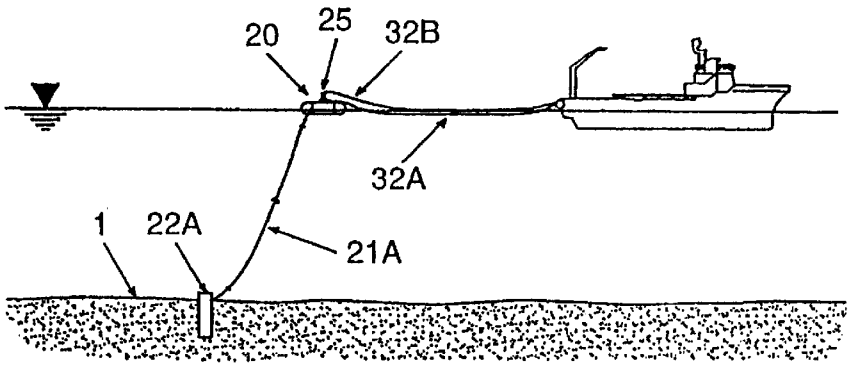
Fig. 8A
Fig. 8B
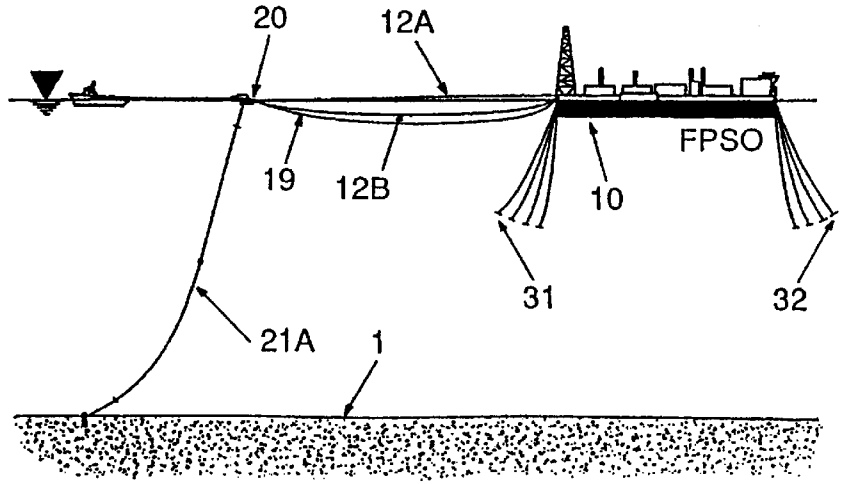
Fig. 8C
Fig. 8D

SYSTEM FOR TRANSFERRING FLUIDS AND METHODS FOR INSTALLING, MODIFYING AND OPERATING SYSTEM

BACKGROUND OF THE INVENTION

This invention is primarily directed to a system and methods for use in offshore oil and gas production, where there is in many cases a need for transferring fluids between a floating installation and a tanker. Thus, the floating installation (FPSO) serves for more or less temporary storage of hydrocarbon fluids being produced, with tankers being employed for the actual export of the products.

Systems for such purposes are known, wherein the floating installation is permanently moored to the seabed, and comprising a buoy being moored to the seabed and connected to the installation through a first mooring line and a first fluid transfer line, and being adapted to be connected to the tanker through a second mooring line and a second fluid transfer line.

A typical example of such a system is found in U.S. Pat. No. 5,065,687, describing a mooring buoy to be located on the sea surface and making possible the weathervaning of a moored tanker vessel through a certain, but limited arc of a circle.

The present invention has for an important object to provide a cost effective, reliable fluid offtake system with high operability, for the purposes indicated above. This is obtained by utilizing the principle of a mooring buoy being immersed under the sea surface, as will be described further below.

At this point it should be made clear that submerged mooring buoys as such are previously known, for example from U.S. Pat. No. 5,816,183. This and other examples, however, are not related to the particular arrangement where a large floating installation constitutes an essential component in the complete mooring and fluid transferring system.

The heart of the present system is the buoy, forming a base unit with buoyancy and having all required facilities. It is partly moored to the sea bottom and partly to the FPSO; thus the whole system can assist in mooring the FPSO. Equilibrium of the buoy is ensured by proper load and load attachment, represented mainly by mooring lines connected to the buoy. Means for mooring a shuttle tanker are provided on top of the buoy. All functions on the base unit or buoy may be controlled via an umbilical cable from the FPSO.

As will be seen from the following description the mooring of the buoy is asymmetric, for example by having four mooring lines directed away from the FPSO and two lines attached to the FPSO.

The system according to this invention, as defined in the claims, involves advantages as follows:

No collision danger, as will be present with surface buoys Significantly reduced risk of collision with the floating installation (FPSO).

Eliminates contribution to tanker hawser tension variation by buoy (negligible) movements.

Easy installation with dry (no diving) connections and installation of main components before immersing the mooring buoy.

Simple export hose arrangement from FPSO, with easy installation, inspection and replacement.

270 degrees normal weathervaning/full 360 degrees capability Eliminating polyester mooring line elongation problems.

As a typical example of dimensions and capacities in a practical embodiment of the system according to the invention, the following is given:

| | |
|---|---|
| FPSO (floating installation) of | 300 000 DWT |
| FPSO Length overall | 300 m |
| FPSO Breadth | 58 m |
| FPSO Draught | 10 m (loaded:23 m) |

Export tankers (shuttle tankers) for use with the system can be of sizes substantially corresponding to what is indicated above with respect to the FPSO.

Typical buoy floating depth 50–100 m.

Buoy net buoyancy 250–300 tonnes.

From the above example it will be understood that the mooring capabilities and properties of the system are of utmost importance for performing the tanker loading operations under varying conditions of wind and waves. Thus, the system according to the invention is capable of performing well in more severe conditions than most existing systems. A down time requirement of not more than 1% per year throughout 20 years life time, should be satisfied at the location given.

BRIEF DESCRIPTION OF THE DRAWINGS

In the following description the invention will be explained more in detail with reference to the drawings, in which:

FIGS. 8A–D serve to illustrate important steps in the installation procedure for establishing a practical embodiment of the system according to the invention.

DETAILED DESCRIPTION OF THE PREFERRED EMBODIMENTS

Figure 1:
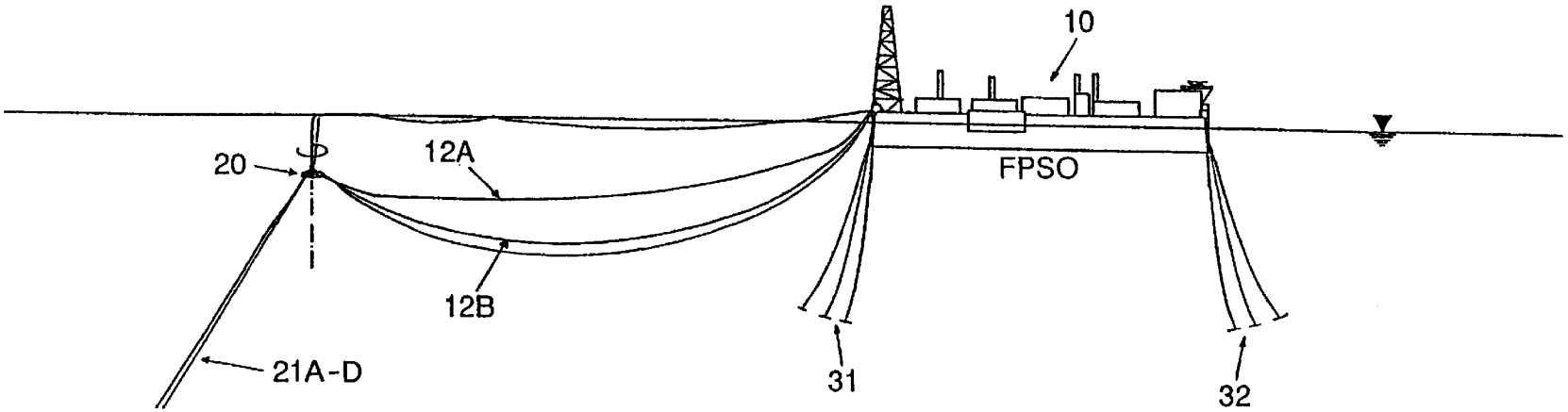
FIG. 1 schematically in elevation shows an embodiment of the system without any tanker moored thereto.
Figure 2:
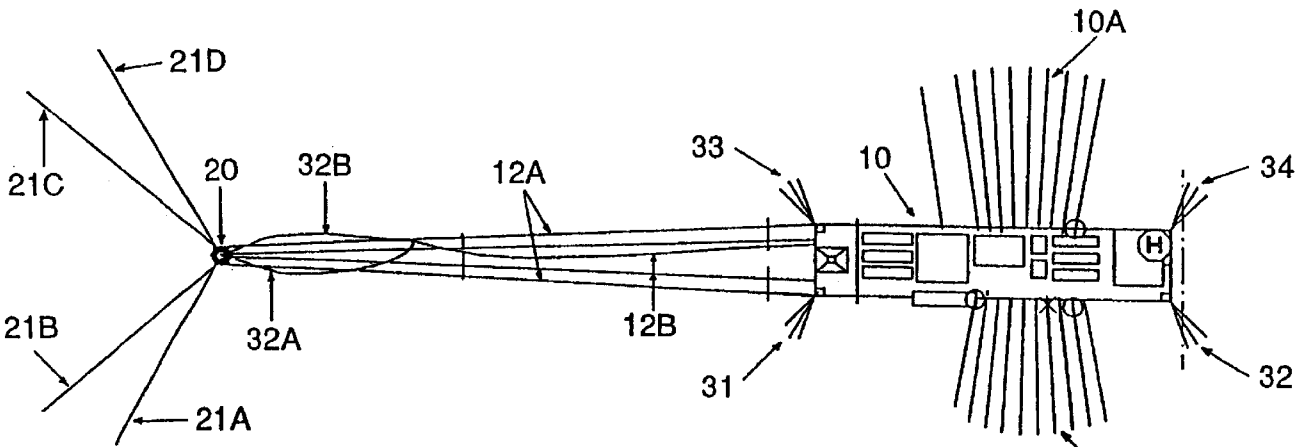
FIG. 2 shows the same arrangement as FIG. 1 in plan view.

In FIGS. 1 and 2 an FPSO—floating installation 10 is shown with moorings 31, 32, 33 and 34 of conventional design, connected to respective anchors at the seabed. The mooring of installation 10 is to be taken as "permanent", i.e. when installed at a given location it is intended to be in service for a long period of time, such as several years. A buoy 20 has also moorings 21A–D with corresponding anchors at the seabed, for example suction anhors.

Between installation 10 and buoy 20 there is provided at least one mooring line 12A; however, two such mooring lines are preferred, as will be seen in FIG. 2. Moreover, at least one fluid transfer line in the form of a flexible riser 12B, is connecting buoy 20 to installation 10, for exporting fluids from the latter.

It is important to note that seabed moorings 21A–D for buoy 20 are all directed more or less away from installation 10. Thus, for balanced or stable mooring of the buoy the one or two mooring lines 12A are required. In this balanced system the immersion depth of buoy 20 can be determined or adjusted, as will be explained further below. It is also to be noted that during regular operations mooring line(s) 12A as well as fluid transfer risers 12B are immersed below the sea surface.

A number of pipelines 10A and 10B as indicated in FIG. 2 are provided for supplying produced fluids to installation 10 from subsea wells or stations (not shown) at the oil or gas field concerned.

Figure 3:
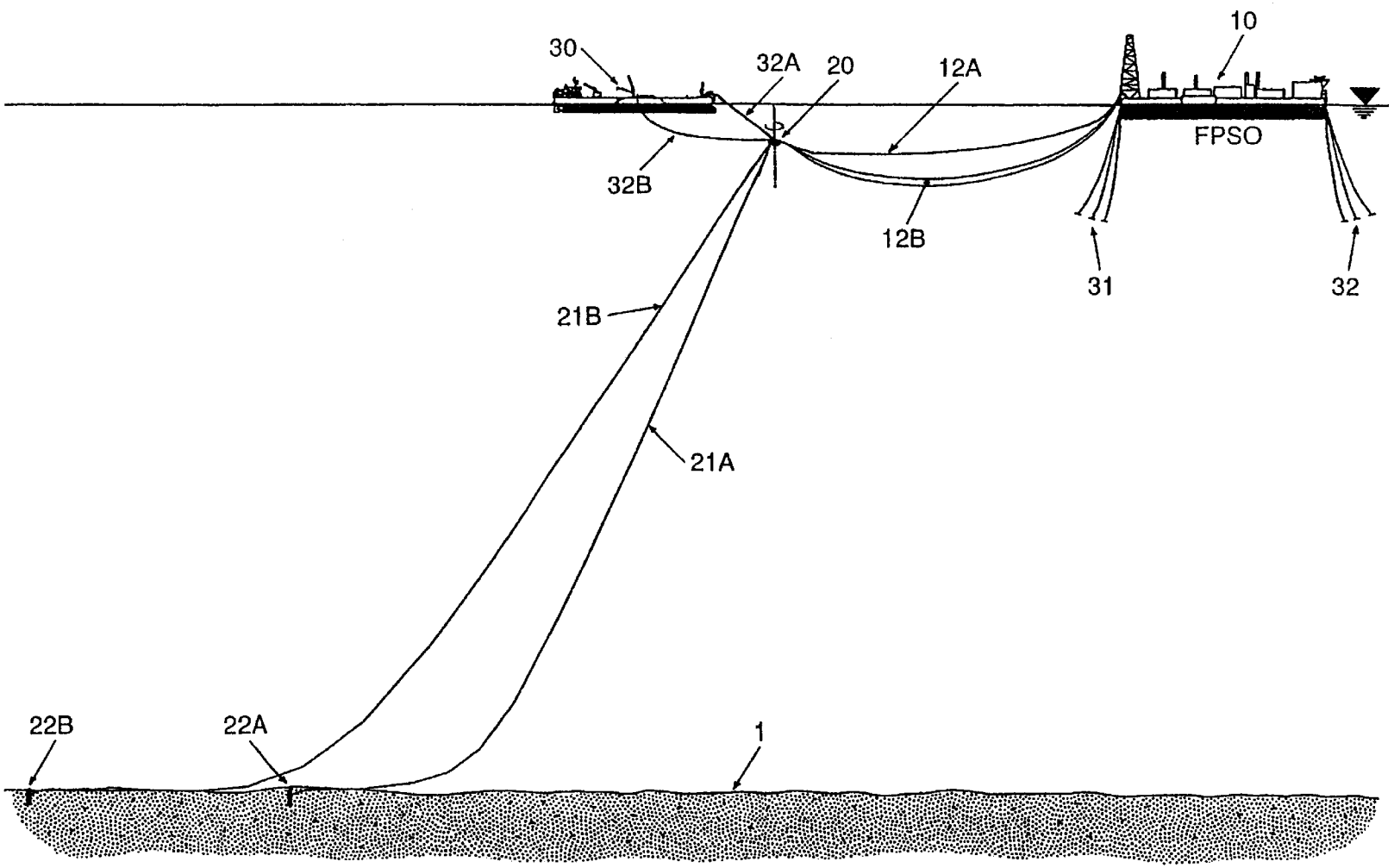
FIG. 3 in elevation shows a complete arrangement including a tanker moored to the buoy incorporated in the system.
Figure 6:
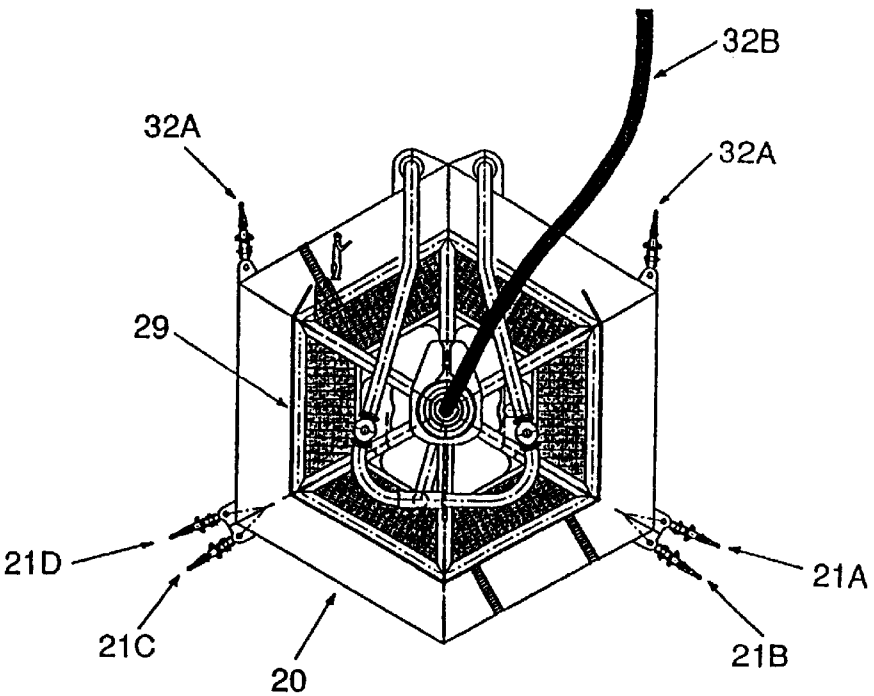
FIG. 6 is a plan view of the same buoy.

In FIG. 3 showing the complete system in operation, suction anchors 22A and 22B in seabed 1 are provided for mooring lines 21A and 21B, respectively. Of course other types of anchors could be used instead of suction anchors, but the latter type is very suitable for the purpose. Tanker 30 is moored to buoy 20 by means of a mooring line 32A in the form of a hawser. There is also a loading hose connecting buoy 20 to the tanker 30, as will be explained more in detail with reference to FIGS. 4, 5 and 6.

Figure 4:
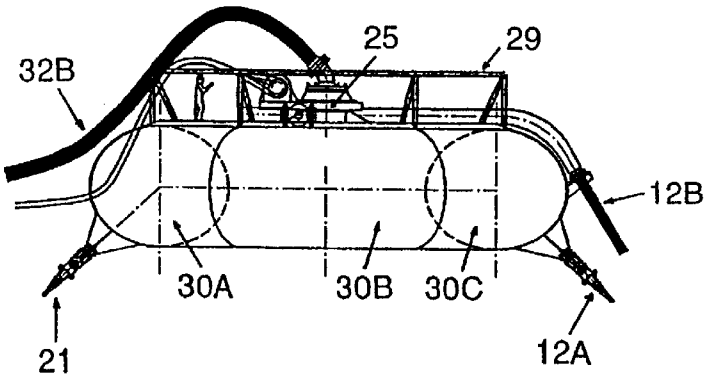
FIG. 4 in side view shows an embodiment of the buoy.

The main structure of buoy 30 comprises six buoyant compartments in a symmetrical arrangement. In FIG. 4 three of these compartments have been denoted 30A, 30B and 30C, respectively. Attachment points are shown at the lower portion of the buoy for seabed moorings 21A–D and the two mooring lines 12A for connection to FPSO installation 10. Centrally at the top of the buoy there is a swivel 25 for mooring line 32A and loading hose 32B.

Figure 5:
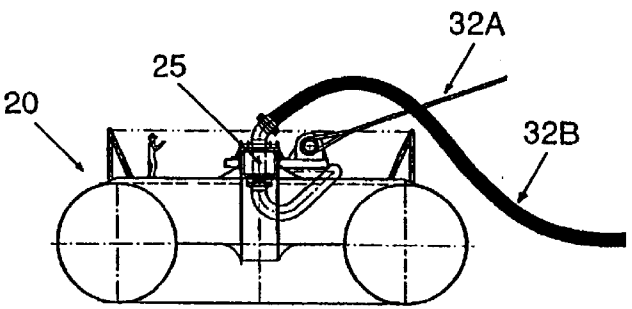
FIG. 5 is a mid sectional view of the buoy in FIG. 4.

Whereas in FIG. 4 the line or hawser 32A is shown in an idle position, the line is in a tensioned condition as illustrated in FIG. 5, thus indicating that a tanker is moored to the buoy (see FIG. 3). Swivel 25 can be of a design being in principle known per se, with swivel rotation effected primarily by the force exerted by hawser 32A when tensioned by a tanker. A guardrail 29 has been provided for hawser 32A.

It is an advantage to have both loading hose 32B and fluid transfer lines or risers 12B of a relatively flexible, marine hose type, as commercially available. Preferably, the free end of marine loading hose 32B is hauled adjacent to and stored at the floating installation 10 during periods when no tanker is being loaded. When a tanker is to be loaded, the hose 32B is usually connected to a midship manifold on the tanker.

Figure 7:
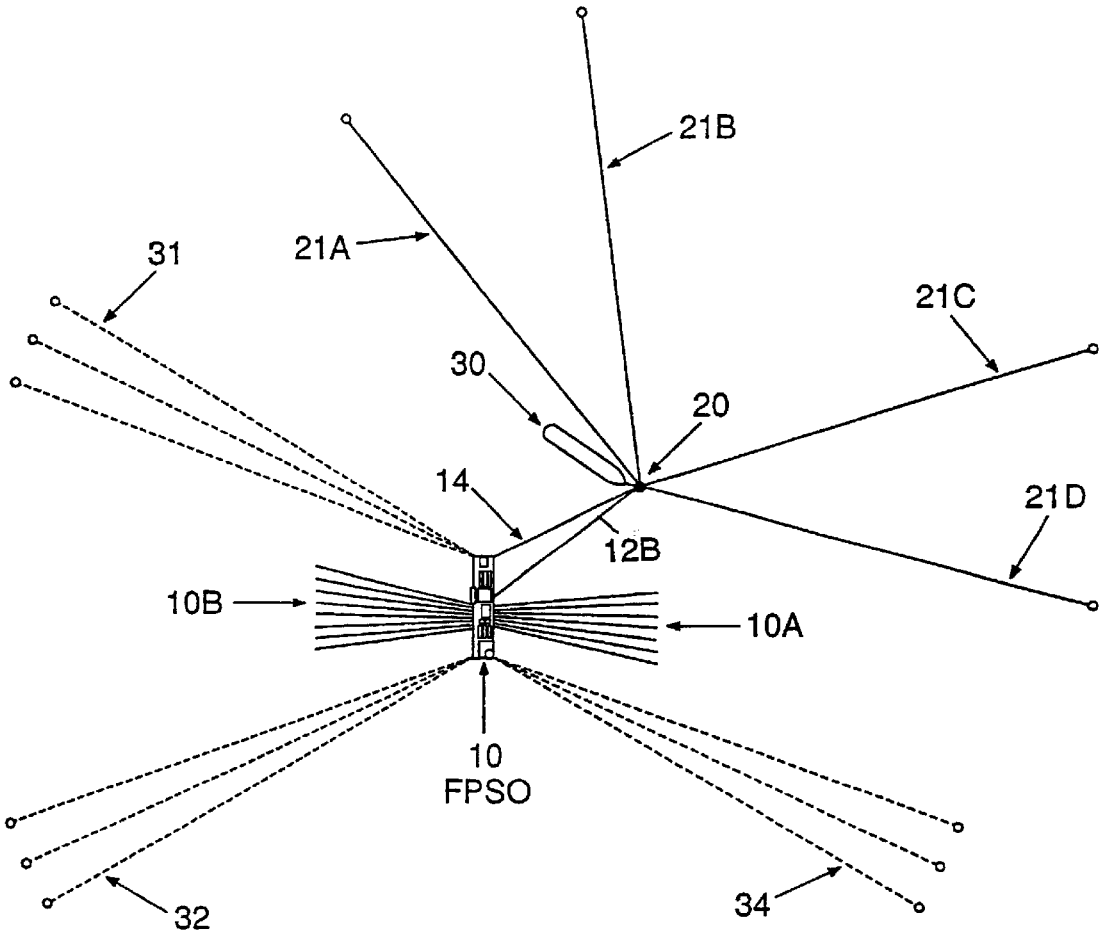
FIG. 7 in plan view shows a variant of the mooring arrangement in FIG. 2.

Turning now to FIG. 7 there is illustrated an arrangement where the mooring line 14 between installation 10 and buoy 20 has replaced one (group of) permanent mooring normally present with installation 10. Moorings 31, 32 and 34 are as in the arrangement of FIG. 2, but mooring 33 is no longer required, since mooring line 14 to buoy 20 has taken over the function of mooring 33. This results in a much simplified and less expensive system. The balanced configuration as explained above is still fully possible, with mutually advantageous mooring cooperation between buoy 20 and floating installation 10.

The method of installing the system according to the invention comprises steps and operations to be explained with reference to FIGS. 8A–D, showing in a simplified manner certain important steps. These comprise permanently mooring the floating installation to the seabed and mooring the buoy to the seabed. The order of performing these two operations is not decisive.

In FIG. 8A a situation is shown, where a suction anchor 22A has already been set in seabed 1, and an assisting vessel is engaged in the mooring of buoy 20 by means of line 21A. The latter can for the most part consist of a polyester rope, with a bottom chain portion near anchor 22A as well as an upper chain portion near buoy 20.

Buoy 20 being moored to the seabed 1, FIG. 8B illustrates how the buoy is furnished with mooring hawser 32A and floating hose 32B, both being connected to swivel 25 on the buoy. The floating installation is not seen in FIGS. 8A–8B.

FIG. 8C illustrates the installation of mooring line(s) 12A between buoy 20 and FPSO 10, seabed mooring 31 and 32 of the latter being already provided for in a conventional manner.

Then finally FIG. 8D shows installation of two loading hoses or risers 12B for the transfer of fluids from FPSO 10 to buoy 20, as well as an umbilical cable 19 for control of the buoy. Still in the situation of FIG. 8D however, buoy 20 is floating in a surface position.

Turning now again to FIGS. 1 and 3 the buoy is brought to the immersed position shown therein, by means of winches on FPSO installation 10 that are operated to tension mooring 12A. Proper balancing of all mooring lines incorporated in the system, and loads carried by buoy 20, will secure the desired configuration also when a tanker is moored, as shown in FIG. 3. It will be understood that mooring of a tanker 30 involves the tendency for buoy 20 to ascend somewhat from its idle position depth, but this can be taken into account when adjusting the mooring system as a whole. Supplementary adjustment can be effected any time by means of winches in FPSO 10, as mentioned above.

In this connection it is contemplated that such FPSO equipment can be used for bringing the buoy from its immersed position to a surface position, by slackening or paying out of the mooring line 12A to a suitable degree. This is an advantageous feature making possible easy inspection and maintenance of the buoy.

What is claimed is:

1. A system for transferring fluids between a floating installation and a tanker, wherein the floating installation is permanently moored to the seabed, said system comprising:

a buoy moored to the seabed and connected to the installation through a first mooring line and a first fluid transfer line, wherein the buoy is adapted to be connected to the tanker through a second mooring line and a second fluid transfer line, wherein the buoy is drawn to an immersed operative position by the first mooring line and is provided with a swivel for the second mooring line and the second fluid transfer line so that fluids are transferable to the tanker through the second fluid transfer line while the buoy is in the immersed operative position.

2. The system according to claim 1, wherein said buoy is moored to the seabed by a plurality of mooring lines extending from the buoy in a direction generally away from said installation.

3. The system according to claim 1, wherein said first mooring line and said first fluid transfer line are immersed in the sea.

4. The system according to claim 1, wherein said first fluid transfer line is flexible.

5. A method of installing a system for transferring fluids between a floating installation and a tanker, the method comprising the steps of:

permanently mooring the floating installation to the seabed;

mooring a buoy to the seabed;

connecting the buoy to the installation through a first mooring line and a first fluid transfer line;

providing a second mooring line and a second fluid transfer line at the buoy for connecting the buoy to a tanker, wherein a terminating adjustment of the moorings in said system is provided for by tensioning said first mooring line at the floating installation end thereof, thereby lowering the buoy to an immersed position.

6. The method according to claim 5, wherein before said step of mooring the buoy to the seabed, the buoy is in a surface position and is towed to the floating installation, and wherein while the buoy is in surface position the buoy is provided with seabed mooring lines, said first mooring line, said fluid transfer line, said second mooring line, and said second fluid transfer line.

7. A method of modifying a system for transferring fluids between a floating installation and a tanker, the system comprising a buoy moored to the seabed and connected to the installation through a first mooring line and a first fluid transfer line, wherein the buoy is adapted to be connected to the tanker through a second mooring line and a second fluid transfer line, wherein the buoy is immersed in the sea in an operative position and is provided with a swivel for the second mooring line and the second fluid transfer line, the method of modifying the system comprising the step of:

raising said buoy from its immersed position to a surface position by detensioning or extending said first mooring line.

8. A method of modifying a system for transferring fluids between a floating installation permanently moored in a body of water, and a tanker, comprising:

mooring a buoy to the seabed, the buoy being adapted to be connected to the tanker through a first mooring line and a first fluid transfer line;

connecting the buoy to the installation through a second mooring line and a second fluid transfer line while the buoy is in an inoperative floating position on a surface of the body of water; and drawing the buoy down from the inoperative floating position to a submerged operative position a predetermined depth below the surface of the body of water by drawing in the second mooring line and pulling the buoy down to the operative submerged position.

9. A method according to claim 8, further comprising: providing the buoy with a swivel for the first mooring line and the first fluid transfer line.

10. A method according to claim 8, further comprising: allowing the buoy to rise from its submerged operative position to the inoperative floating surface position by paying out the second mooring line.

11. A method according to claim 8, comprising: using the mooring of the buoy and the second mooring line as part of the mooring of the floating installation.

* * * * *